US005140956A

United States Patent [19]

Seward

[11] Patent Number: 5,140,956

[45] Date of Patent: Aug. 25, 1992

[54] VALVE GUIDE RELINING SLEEVE

[75] Inventor: Keith A. Seward, Chipping Norton, Australia

[73] Assignee: Gapan Holdings Pty Limited, Chipping Norton, Australia

[21] Appl. No.: 744,357

[22] Filed: Aug. 13, 1991

[51] Int. Cl.[5] ..... F01L 3/08

[52] U.S. Cl. ..... 123/188.9; 29/888.42

[58] Field of Search ..... 123/188.9, 188.1; 29/888.41, 888.42

[56] References Cited

U.S. PATENT DOCUMENTS

| | | | |
|---|---|---|---|
| 2,778,352 | 1/1957 | Kimberly | 123/188.9 |
| 3,265,052 | 8/1966 | Goloff | 123/188.9 |
| 3,809,046 | 5/1974 | Kammeraad | 123/188.9 |
| 3,828,415 | 8/1974 | Kammeraad | 123/188.9 |
| 3,828,756 | 8/1974 | Kammeraad et al. | 123/188.9 |
| 4,103,662 | 8/1978 | Kammeraad | 123/188.9 |
| 4,465,040 | 8/1984 | Pelizzoni | 123/188.9 |
| 4,768,479 | 9/1988 | Kammeraad | 123/188.9 |
| 5,041,168 | 8/1991 | Purnell | 29/888.41 |

*Primary Examiner*—E. Rollins Cross
*Assistant Examiner*—Erick Solis
*Attorney, Agent, or Firm*—Ladas & Parry

[57] ABSTRACT

A sleeve for lining a valve guide of an internal combustion engine and being able to receive a valve stem therethrough, has a seam that extends the length thereof. The inner surface of the sleeve has a plurality of spaced apart indentations. The indentations are formed in rows down the sleeve and each row has at least two indentations.

18 Claims, 2 Drawing Sheets

VALVE GUIDE RELINING SLEEVE

FIELD OF INVENTION

The present invention relates to a sleeve for lining a valve guide of an internal combustion engine so as to ensure that the valve stem receives adequate lubrication during its oscillatory movement within the guide whilst substantially eliminating the migration of oil to the combustion chamber.

BACKGROUND ART

Australian Patent Specification No. 586,341 discloses a slitted tubular valve guide insert having a substantially spiral groove along the entire length of its inner surface. At each point of intersection between the spiral groove and the slit or seam, the adjacent open ends of the substantially spiral groove are offset to create a linear discontinuity in the spiral groove. The spiral groove is, therefore, divided into a plurality of inclined groove segments. It is suggested in Australian Patent Specification No. 586,341 that by dividing the substantially spiral groove into a plurality of inclined, discrete groove segments, oil flow along the substantially spiral groove to the combustion chamber will be greatly reduced or eliminated during operation of the engine.

It has however, been found by the present inventor that during engine operation, the above arrangement suffers from a gradual leakage of oil down each of the inclined groove segments to the seam, where the accumulated oil passes downwardly to be released into the combustion chamber. Furthermore, the provision of a transverse portion to the seam does not significantly inhibit such oil flow. Whilst it is suggested that the combined effect of the oscillatory and rotational movement of the valve stem through the valve guide is to pick up and evenly spread the oil that is in the groove segments throughout the surface of the valve stem, it has been found by the present inventor that much of the oil that is within each of the groove segments is not picked up by the surface of the moving valve stem as it abuts against the innermost face of the valve guide but rather spills out into the seam.

The effect of having a succession of groove segments that open out into the seam coupled with having a single transverse portion of the seam where misalignment of the corresponding opposite edges of the sleeve is likely to occur are seen by the present inventor as the primary causes of this spillage. As a result, accumulated oil loss to the combustion chamber still occurs at unsatisfactorily high levels.

It is an object of the present invention to substantially ameliorate the disadvantages of the prior art.

DISCLOSURE OF THE INVENTION

According to the invention there is provided a sleeve for lining a valve guide of an internal combustion engine and adapted to receive a valve stem therethrough, said sleeve having a seam extending the length thereof, the inner surface of the sleeve having a plurality of spaced apart elongated indentations, the spacing of the indentations being such that they are formed in rows down the sleeve with each row being comprised of at least two spaced apart indentations.

Preferably, the direction of elongation of each indentation in each row is perpendicular to the longitudinal axis of the sleeve.

In another preferred form, the indentations of one row are staggered in relation to the indentations of an adjacent row.

In a further preferred form, each indentation from any one row has at least one end portion thereof that overlaps an end portion of an identation of an adjacent row according to an axial line of reference.

The successive rows of identations may be interrupted by a portion or portions of the sleeve lacking rows of indentations, and, where there is a single such portion, said portion may be located substantially adjacent to the midpoint of the length of the sleeve.

Preferably, the elongated indentations are rectangular in shape and the outermost indentations of each row do not intersect across the seam.

BRIEF DESCRIPTION OF THE DRAWINGS

In order that the invention may be more readily understood and put into practical effect, reference will now be made to the accompanying drawings in which FIG. 1 a is broken away sectional side elevational view of a typical valve assembly of an overhead valve engine that includes an inserted sleeve according to one embodiment of the invention.

DESCRIPTION OF PREFERRED EMBODIMENT

Figure 1:
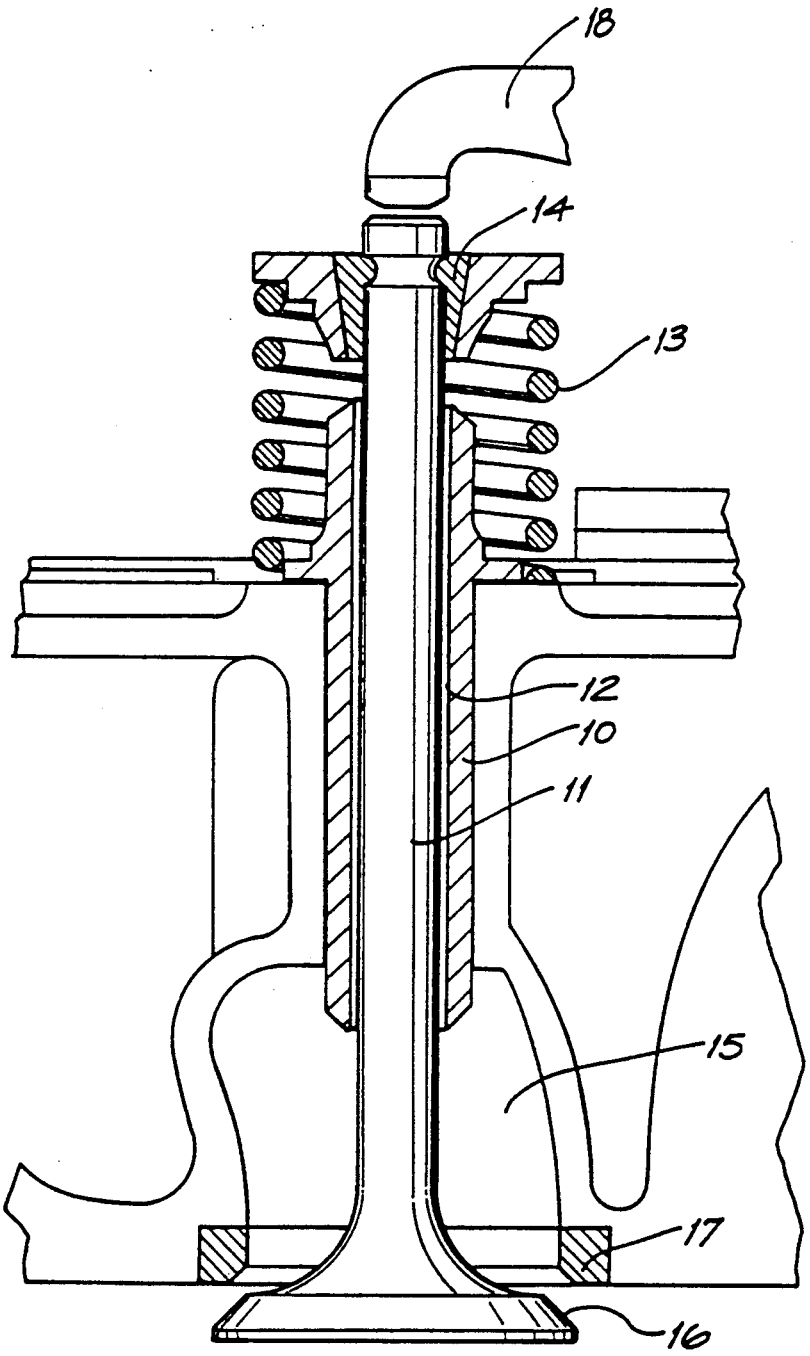

The valve assembly of FIG. 1 has a valve guide 10 housing a valve stem 11. A sleeve 12 is inserted by interference fit against the wall of the valve guide 10 and closely abuts against the valve stem 11. The sleeve 12 will be described in more detail below. A valve spring 13 encircles the upper portion of the valve guide 10. A pair of valve keepers 14 retain the valve stem 11 in its operative position. The valve stem 11 extends downwardly into an engine combustion chamber 15 and terminates in a valve face 16. In its recipratory movement, the valve face 16 is periodically received by a seat 17 to the combustion chamber 15 by upward force of the spring 13 and is caused to move away rom the seat 17 by operation of the rocker arm 18.

Figure 2:
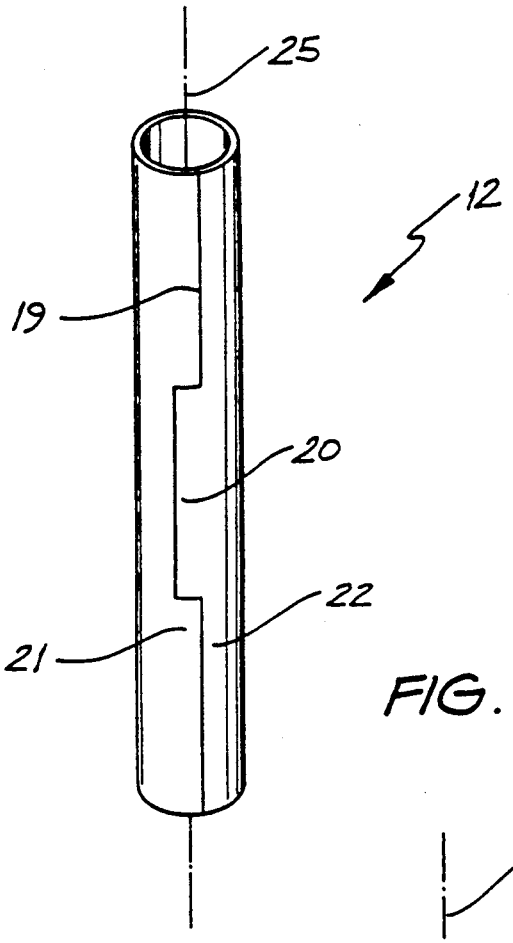
FIG. 2 is a perspective view of the isolated sleeve of FIG. 1.

The sleeve 12 shown in FIG. 2 is a cylindrical shape and has an end to end seam 19 that defines a lock tag arrangement 20 at the midpoint thereof. The seam 19 is, therefore, divided into three longitudinally oriented seam lines that provide for tight alignment between the complementary side portions 21 and 22 of the sleeve 12 when it assumes an interference fit within the valve guide 10.

Figure 3:
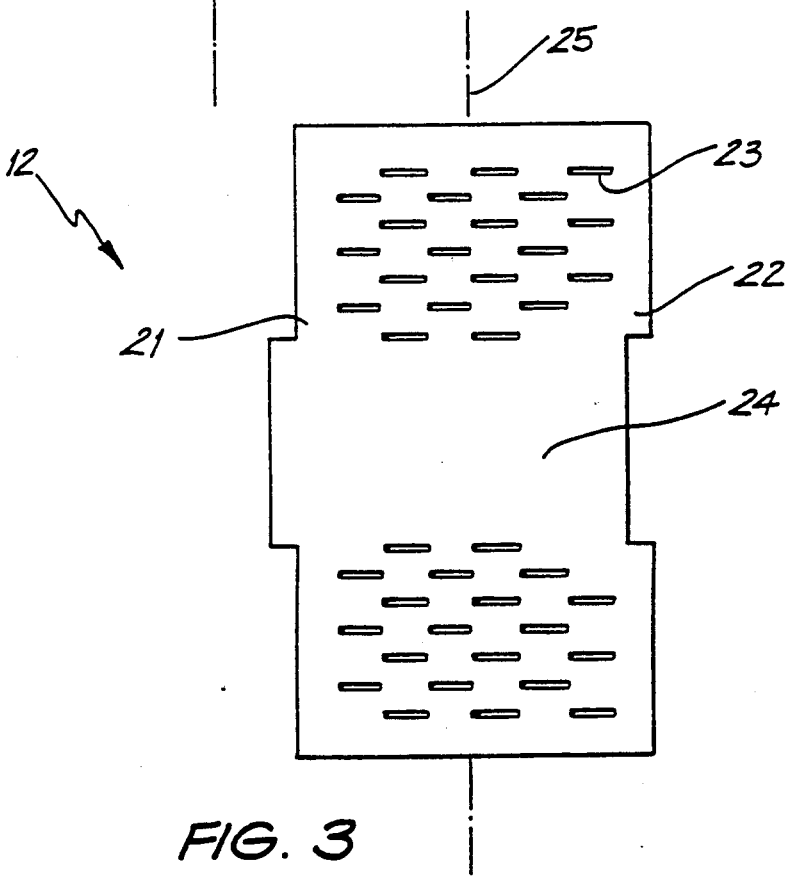
FIG. 3 is a view of the developed inner surface of the sleeve of FIG. 2 before being roll formed into a cylindrical sleeve.

The developed inner surface of the sleeve 12 shown in FIG. 3 has a series of rows of evenly spaced apart rectangular indentations 23 pressed therein. The longitudinal axis of each rectangular indentation 23 is perpendicular to the longitudinal axis 25 of the sleeve 12. The rectangular indentations 23 of any one row are staggered in relation to the rectangular indentations 23 of the adjacent row. When viewed according to an axial line of reference, each rectangular indentation 23 partly overlaps an adjacent staggered rectangular indentation 23.

The portion 24 of the sleeve 12 located adjacent its midpoint lacks rows of indentations. This is because most of the wear between stem 11 and sleeve 12 occurs at opposite ends of the sleeve remote from the midpoint.

Although not drawn to scale, the most peripheral rectangular indentations 23 of each row come to within 1 millimeter of either of the side portions 21 and 22. It is important that care be taken in the manufacture of the preferred sleeve 12 to ensure that none of the indentations 23 intersect the seam line 19 as even with the improved seam alignment profile of this embodiment some spillage of oil from an indentation having an opening to the seam may occur, albeit in small amounts and infrequently.

Preferably the sleeve 12 is constructed of a phosphor bronze material which does not absorb lubrication oil as would more porous sleeve materials such as cast iron.

Preferably the rectangular indentations 23 are approximately 3 millimeters (mm) in length, 0.25 mm in width and 0.12 mm in depth.

The fitting of the sleeve 12 into the valve guide 10 is by conventional means.

Various modifications may be made in details of design and construction without departing from the scope or ambit of the invention.

I claim:

1. A sleeve for lining a valve guide of an internal combustion engine and adapted to receive a valve stem therethrough, said sleeve having a seam extending the length thereof, the inner surface of the sleeve having a plurality of spaced apart elongated indentations, the spacing of the indentations being such that they are formed in rows down the sleeve with each row being comprised of at least two spaced apart indentations.

2. The sleeve of claim 1 wherein the direction of elongation of each indentation in each row is perpendicular to the longitudinal axis of the sleeve.

3. The sleeve of claim 1 wherein the indentations of any one row are staggered in relation to the indentations of an adjacent row.

4. The sleeve of claim 1 wherein each indentation from any one row has at least one end portion thereof that overlaps an end portion of an identation of an adjacent row according to an axial line of reference.

5. The sleeve of claim 1 wherein the successive rows of indentations are interrupted by a portion or portions of the sleeve lacking rows of indentations.

6. The sleeve of claim 5 wherein the portion of the sleeve lacking rows of indentations is located substantially adjacent to the midpoint of the length of the sleeve.

7. The sleeve of claim 1 wherein the elongated indentations are rectangular in shape.

8. The sleeve of claim 1 wherein the outermost indentations of each row do not intersect across the seam.

9. The sleeve of claim 1 wherein the seam defines a lock tag arrangement at the midpoint thereof.

10. The sleeve of claim 1 wherein the rows of indentations are evenly spaced apart.

11. The sleeve of claim 1 wherein the outermost indentations of each row come to within 1 mm of the seam.

12. The sleeve of claim 1 wherein the sleeve is constructed of a phophor bronze material.

13. The sleeve of claim 1 wherein the indentations are rectangular in shape and have a length of 3 mm, a width of 0.25 mm and a depth of 0.12 mm.

14. A sleeve for lining a valve guide of an internal combustion engine and adapted to receive a valve stem therethrough, said sleeve having a seam extending the length thereof, the inner surface of the sleeve having a plurality of spaced apart elongated indentations, the spacing of the indentations being such that they are formed in rows down the sleeve with each row being comprised of at least two spaced apart indentations, the direction of elongation of each indentation in each row being perpendicular to the longitudinal axis of the sleeve and the indentations of one row being staggered in relation to the indentations of an adjacent row, each indentation from any one row having at least one end portion thereof that overlaps an end portion of an indentation of an adjacent row according to an axial line of reference, the successive rows of indentations being interrupted by a portion or portions of the sleeve lacking rows of indentations and located substantially adjacent to the midpoint of the length of the sleeve.

15. A method for lining a wall of a valve guide of an internal combustion engine, comprising:

applying against a wall of a valve guide a sleeve, said sleeve having a seam extending the length thereof, the inner surface of the sleeve having a plurality of spaced apart elongated indentations, the spacing of the indentations being such that they are formed in rows down the sleeve with each row being comprised of at least two spaced apart indentations, the direction of elongation of each indentation in each row being perpendicular to the longitudinal axis of the sleeve and the indentations of one row being staggered in relation to the indentations of an adjacent row, each indentation from any one row having at least one end portion thereof that overlaps an end portion of an indentation of an adjacent row according to an axial line of reference, the successive row of indentations being interrupted by a portion or portions of the sleeve lacking rows of indentations and located substantially adjacent to the midpoint of the length of the sleeve.

16. The method of claim 15 wherein the sleeve is applied against the wall of the valve guide by an interference fit.

17. A method for lining a wall of a valve guide of an internal combustion engine, comprising:

applying against a wall of a valve guide a sleeve for receiving a valve stem therethrough, said sleeve having a seam extending the length thereof, the inner surface of the sleeve having a plurality of spaced apart elongated indentations, the spacing of the indentations being such that they are formed in rows down the sleeve with each row being comprised of at least two spaced apart indentations.

18. The method of claim 17 wherein the sleeve is applied against the wall of the valve guide by an interference fit.

* * * * *